United States Patent [19]

de Oliveira Filho et al.

[11] Patent Number: 4,984,935

[45] Date of Patent: Jan. 15, 1991

[54] FLOATING ENCLOSED OFFSHORE SUPPORT STRUCTURE

[75] Inventors: Florêncio de Oliveira Filho, Curitiba; Valtair P. L. Pires, Rio de Janeiro, both of Brazil

[73] Assignees: Petroleo Brasileiro S.A. -Petrobras, Rio de Janeiro; Empresa de Portos do Brasil S.A. -Portobras, Brasilia, both of Brazil

[21] Appl. No.: 136,324

[22] Filed: Dec. 22, 1987

[30] Foreign Application Priority Data

Dec. 22, 1986 [BR] Brazil ..... 18606370

[51] Int. Cl.[5] ..... B63B 35/44; E02B 3/06

[52] U.S. Cl. ..... 405/224; 114/263; 114/265; 405/26; 405/76; 405/211

[58] Field of Search ..... 405/195, 200, 203, 26, 405/27, 30, 31, 75, 76, 211, 219, 224; 114/264, 45, 263, 266, 267, 265

[56] References Cited

U.S. PATENT DOCUMENTS

| | | | |
|---|---|---|---|
| 2,641,108 | 6/1953 | Montgomery et al. | 405/76 |
| 2,744,483 | 5/1956 | Rhindress | 114/263 |
| 2,994,201 | 8/1961 | Hutchings | 405/27 |
| 3,592,155 | 7/1971 | Rosenberg | 114/266 X |
| 4,241,685 | 12/1980 | Mougin | 114/264 |
| 4,364,691 | 12/1982 | Wirt | 405/26 |

FOREIGN PATENT DOCUMENTS

| | | | |
|---|---|---|---|
| 122317 | 6/1986 | Japan | 405/27 |

*Primary Examiner*—David H. Corbin

*Attorney, Agent, or Firm*—Sughrue, Mion, Zinn, Macpeak & Seas

[57] ABSTRACT

A floating structure to support maritime operations is constituted by a metallic platform, in the shape of an internally open square (10) floating in the ocean being moored to the bottom of the ocean by a cable system ($C_1$, $C_2$, $C_3$ . . . $C_n$) tied to a pile system ($E_1$, $E_2$, $E_3$ . . . $E_n$). It retains in its interior a portion of the sea which is communicated to the outside ocean through an opening (11) in the walls of the said metallic platform (10) in such a way that, in that confined part of the ocean, the support boats to the sea work, may be moored due to the fact the interior of the open square is calm in respect to the rough sea outside the structure (10). For the confined sea body to be calm contributes the resistance offered to the wave impact by the lateral walls (16, 18, 19) of structure (10), which are submerged down to a wet depth of more than 30 meters and also because the wall (18) possess deflecting devices (20) of the water and chambers (21) to dampen the wave impact.

11 Claims, 5 Drawing Sheets

FIG. 3
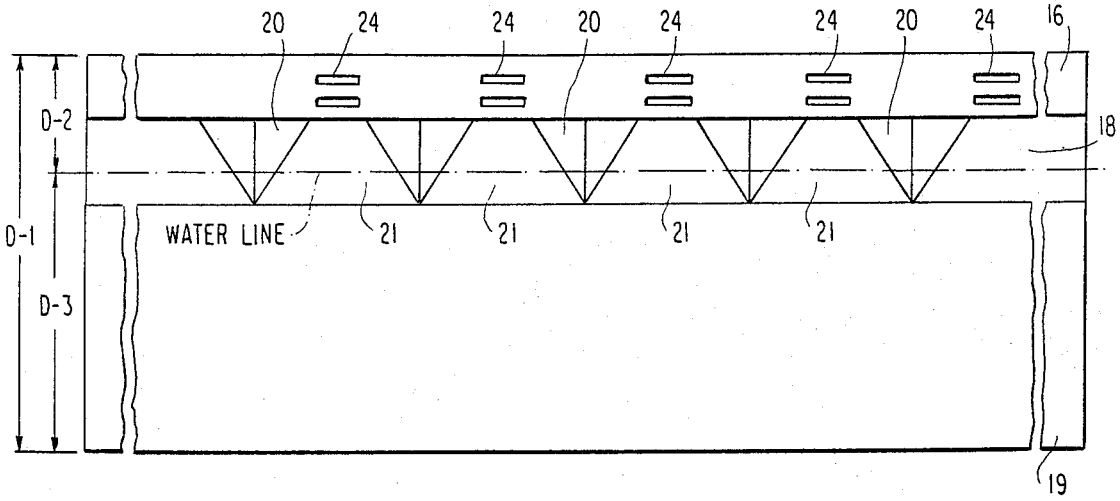
FIG. 4
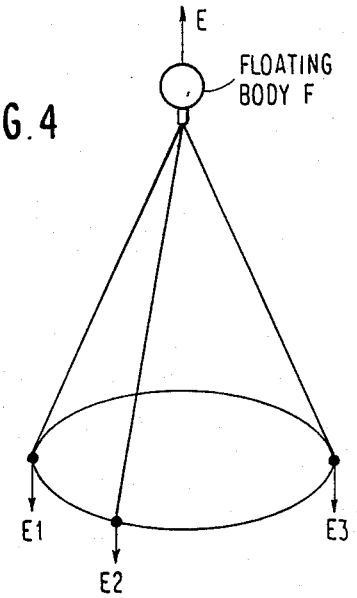
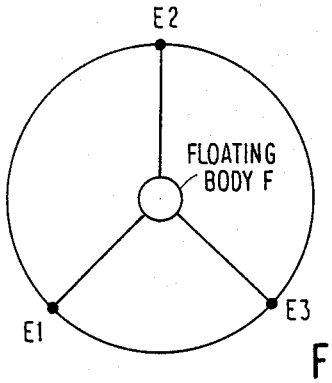
FIG. 5

FLOATING ENCLOSED OFFSHORE SUPPORT STRUCTURE

This invention concerns a floating structure which is to be anchored offshore in such a way as to be properly stable and to withstand the action of sea water and thus be used as a shelter for vessels and or to bear support facilities for offshore work, as for instance, a maintenance workshop, fire station, storage space for crude oil, drinking water etc.

In offshore work, for example, oil exploration and production platforms, one of the major questions has been the way they have to depend upon support from outside, which usually comes from on shore and this means that everything has to be carried over the sea, or, in special cases, by air. In addition to the cost of carriage, where by sea for instance, such supply may be seriously hindered by the state of such sea and more so when long distances have to be overcome from the coast to a platform.

Hence one of the purposes of this invention is to provide a structure of novel design which may be towed out to sea, and positioned close to a platform, or strategically equidistant from several platforms, in a given field, where exploration and production work is going on, there to act as a safe shelter for supply boats.

Another purpose of this invention is to provide a self-floating structure which can also be suitably and safely moored so as to enable it to become an efficient means of support and to as wide an extent as may be required.

Another purpose of this invention is to provide a stable anchored floating facility at some spot in the ocean, and which will be designed as a safe shelter for boats, within which rough seas might be calmed or totally prevented by means of given technical features that are part of such structure.

Another purpose of this invention is to describe a floating support facility, moored in the ocean itself, close to an oil drilling or producing platform and which facility may bear storage space for equipment and chemicals for the job, fire-fighting gear, a floating hotel, a power station, a heliport, points at which support boats may be discharged, etc.

To better understand this invention the attached figures are provided, to convey a typical notion of it though without in any way limiting it.

Namely:

FIG. 3 is a schematic front view of the upper works of the enclosed floating support structure shown in FIG. 1 with the side that faces the oncoming waves.

FIGS. 4 and 5 are simplified schematic and diagramatic views of the mooring system for the enclosed oceanproof floating facility, to show forces acting on the system.

DETAILED DESCRIPTION OF THE PREFERRED EMBODIMENT

Figure 1:
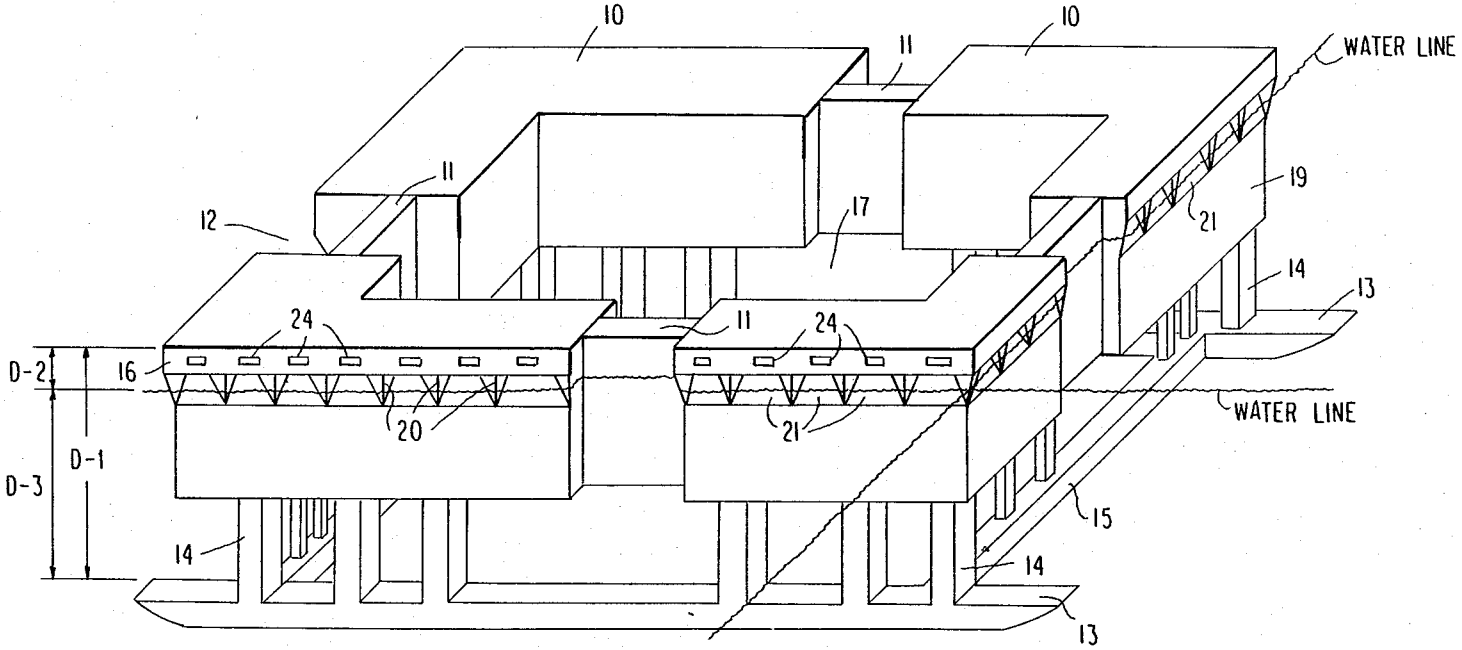
FIG. 1 is a perspective view of an enclosed floating support structure shown as a whole, in perspective.
Figure 2:
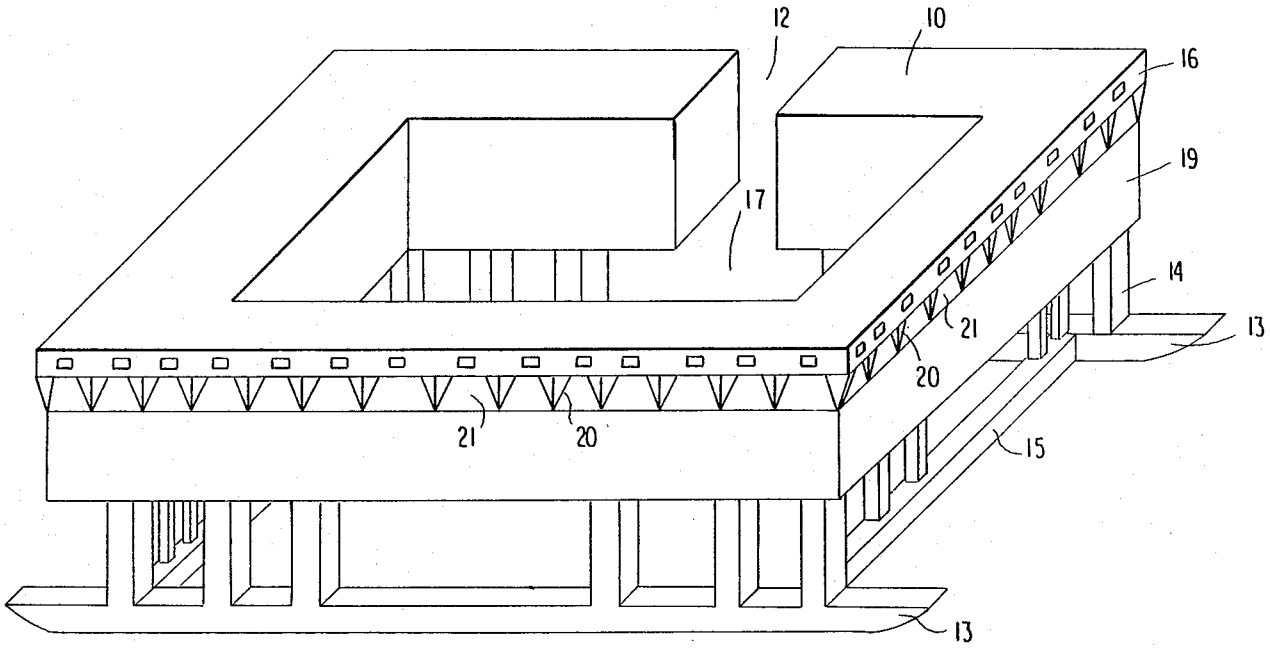
FIG. 2 is another isometric view of a alternate embodiment of under this invention.

A detailed description of FIGS. 1, 2 and 3, where elements of equal function bear the same numbers makes clear, the proposed design.

In the above mentioned figures, the structure proposed in this invention is shown in its main elements.

An upper metallic platform (10) is the main body of the Floating Structure, which is shown in the present configuration only as an example with the shape, as viewed from the top, of a square with one internal hole. The upper part of said metallic platform is wide enough for the support services to be installed on it and still permit personnel movement during normal operation. In FIG. 1, each face of the "square" has an opening (12) which is kept closed by a gate (11) which, on occasion seals the access to the interior (17) of the platform. In FIG. 2 just one opening (12) is left for communication of the interior or inner part (17) with the ocean outside. The later, the configuration in FIG. 2 is preferred. The FIG. 1 configuration is shown only to give an idea of the many permitted possibilities for the present construction.

The upper metallic platform (10) is supported by vertical columns (14) steming from the floats (13). Said floats (13) are long hollow metallic bodies which stay submerged in water, thus providing means for the whole structure formed by the upper platform (10), supporting legs (14) and the floats themselves (13) to provide a stable floating assembly, not to mention the posibility of horizontal displacement as shall be seen later on.

It should be noted that the bulk of the upper platform Structure is only partially emergent. Later on it shall be see that part of the platform (considered in bulk) will remain submerged to provide a damper against the wave motion of rough seas, thus minimizing the action of oceanic streams such that the structure inner waters may provide a safe and calm marina for boat sheltering.

Only as part of a construction concept necessary to the Structure floating stability, the floats are tied together by horizontal beams (15). This aspect, however is an evident solution for the specialists in the field, and is not compulsory, as other types of reinforcement can be incorporated without deviating from the scope of the present invention.

With reference to the structure outer walls which are exposed to the oceanic impact, as shown in a general way on FIGS. 1 and 2 and with more details in FIG. 3, we see that they are formed by three distinct parts or walls 16, 18, 19 which provide different functions. Thus, the upper part or wall 16 is vertical and flat, all of it standing above the water level. It is, not essential that the four Floating Structure faces be formed by these three distinct parts, it is enough, in the most common case, that this subdivision be present only in the face that bears the waves front impact. However, to get an overall vision of how it should be structured, especially the intermediate part of the outer wall, that is, face (18) as seen from two angles, FIG. 1 shows that division as formed by two faces on square angles. Therefore, examining FIGS. 1, 2 and 3 we observe that wall (18) is somewhat inclined out of the vertical, thus making wall (19) to be a little bit inwardly offset backwards in respect to wall (16). On the mentioned wall (18) the elements in the shape of a boat bow (20) it can clearly be seen which, as defined, has its lateral walls turned frontwards with the shape of a section of a tetrahedron or a blow of a boat or hull, when looked frontally, being however acceptable, for easy of construction, that the two meeting walls assume the shape of two contiguous faces of a tetrahedron. To help in understanding, the upper and forward parts of said element (20) would be the two other sides of the tetrahedron, which cannot be seen, since the upper face shall be imbedded within the structure, right below the intersecting point with the lower edge of wall (16) and the backwards part shall be turned towards the interior 17 of the Floating Structure. As we see, the element now described as a tetrahedron shall be a solid body, hollow and watersealed on the inside, and which shall also function as an additional floating element.

Between any two bow shaped elements (20) there is an opening (21) which leads to the already mentioned "processing chamber" which is an opening located inside the Floating Structure the description and operational definition of which shall be given later in this specification. It should be made clear, however, that the number of elements shown in the mentioned Figures and their shapes and locations are only given as an example, their exact size, number and location, even in a schematic representation, can only be given in a design for actual manufacture.

FIG. 3 shows an amplified detail of lateral walls (16), (18) and (19) were one can see that wall (18) is formed with the special design that includes the bow shaped elements (20) already referred to when describing FIGS. 1 and 2 and the openings for what was called a "processing chamber". As it has already been said, the bow shaped elements (20) should have lateral walls shaped as the front part of a traditional boat when seen exactly from the front. In an alternative construction, aiming to facilitate construction, instead of having a boatlike shape, one may have the already mentioned protruding elements in the shape of a frontal line resulting from the intersection of two planes from faces of a tetrahedron in such a way that the function of each lateral walls (one of the two intersecting planes) serve as a parting element for the waves incident on wall (18).

Figure 8:
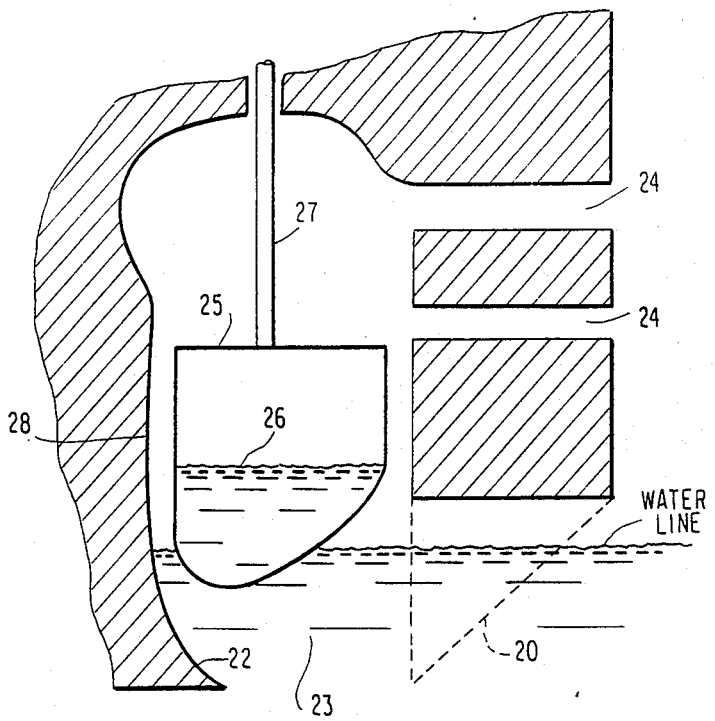
FIG. 8 is a side, enlarged, scale sectional view of of a wave buffer chamber of the present invention.

As already said, the so called "processing chamber" (21) is an opening made in the "hull" of the Floating Structure, located on wall (18) that receives the direct wave impact. Here the wall of one of the boat-bow shaped elements (20) forms with the next element a "vertical channel" (23) to conduct the wave water, into the "processing chamber". It must be clear, and this is a well known fact, that the wave, while exerting its impact on a surface which serves as a baffle plate, normally throws upwards a water column which tends to move back after hitting the obstacle, falling again on the ocean surface. Now, while exerting that impact, the wall hit by the wave will have received the blow and, by an elementary physics principle, reacted to it, causing the water to rise and move back, while, at the same time, the wall vibrates with the blow. This impact, depending on its intensity, may cause such an intense vibration that when the baffle plate is of large dimensions and, besides, is a floating structure, the whole structural integrity may be impaired. As it is known, in the case of a ship hull, the lateral walls that form a sharp intersection, tend to deviate the waves towards the boat sides and to compensate the impact, most frequently with a light movement of the ship, that is, as long as the ship receives the waves by the bow. In the case of the present invention, however, as the impact of the waves against the wall of the Floating Structure shall always be frontwards, the water shall not have a way of being deviated towards the sides of the structure. However, according to the special shape of the wall that receives the direct impact of the waves and which we will here call "combat side", the wave shall be directed upwards towards the "processing chamber"(21), the lower parts of the inner wall (22) of which, as shown in FIG. 8, have a rounded shape to diminish the impact and to orient the rising water column to the vertical channels (23) so that said water column is led through a path where, after deflection in the "processing chamber", 21 or main duct will be discharged to the ocean through the secondary channels (24). The upwards path, to facilitate the understanding, shall be named "main duct" (23).

Figure 9:
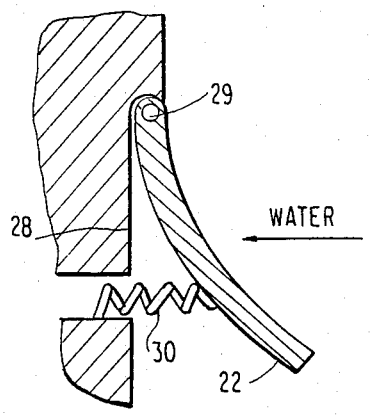
FIG. 9 is schematic section view of design a chamber subject to direct impact of waves.

FIG. 8 shows a schematic elevational view of a section of a "processing chamber" in a preferred configuration. As can be seen in FIG. 8, the bow shaped element (20) is only seen in dotted lines, as it is on a background plane of the diagram, and is here represented to show that it is limiting the inlet opening (21) to the "processing chamber" and orienting the waterflow from the wave towards a given direction, which is the vertical channel or "main duct" (23) whereby the wave shall rise to be dampened by effect of the design of the internal walls (28) and to be expelled by the outlet orifices (24). As already seen, the lower part of the internal wall (28) which is formed by the part (22) that first receives the impact of the wave, has a special concave curvature with the concavity turned to the outer side of the wall (18) of the "combat side". However, should one want in any way that this part be designed to confer some sort of dampening to the wave impact, it may be represented as shown in FIG. 9 in an alternative construction whereby the lower part of the inner wall (28) of the "processing chamber" maybe an element shaped as a lightly curved plate articulated in an articulating point (29) at its upperend and biased, in its medium part, by a spring (30) so designed as to recoil back when plate (22), shown on FIG. 9, receives the wave's direct blow as per the arrow.

Besides having been designed, by virtue of its internal shape, to absorb the wave energy, the "processing chamber" FIG. 8, is provided with a piston (25) which is hollow inside and can have its weight counterbalanced by a certain amount of liquid (26) placed in its interior. It is easily understandable by field experts that the shape of the lower part of said piston (25) does not need to be regular, on the contrary it shall be designed to cooperate with a shape of the inner wall (28) that will facilitate orienting the waterflow that rushes in violently to chamber the processing and having a certain amount of liquid (26) as an interior ballast such as to control the displacement of said piston (25) to prevent a violent impact against the upper wall (28) and provide for a better use of said impact to generate energy, as will be explained next.

Therefore, as seen in FIG. 8, piston (25) is held by rod (27) which extends beyond the upper part of wall (28) and may articulate, in a way not defined in the present invention, with some mechanical system for using energy, or to transmit that energy to an acting medium that promotes some type of improved use of energy besides simple mechanical energy transmission.

However, apart from the possible use of the energy of the wave hitting the walls, it is important that the above described arrangement prevents the action from the violent impact of the waves to be only reflected by the wall of the Fluctuating Structure, which, otherwise, would only cause harmful vibration to the structure.

Examining again, now, FIGS. 1, 2 and 3 with special attention, we see that the total height of the lateral walls (16), (18) and (19) of the structure formed by faces is divided into an emergent part and a submerged part. The emergent part, as seen, is formed by all the vertical plane wall (16), and by part (approximately half) of the intermediate face of wall (18). The submerged part is formed by a fraction of the intermediate wall (10) face (also approximately half of it) and by all the lower flat vertical wall (19) face. If we call D-2 the emergent part, D-3 the submerged part and D-1 the total height, the relation among these heights is an important parameter for the definition of the degree of dampening the structure may offer to the impetus of the waves when the sea is rough. This aspect shall be seen next and likely conclusions be drawn that interest particularly the Structure design.

Examining now FIGS. 4 and 5 a static analogy for all the mooring system of the Floating Structure to a given point in the ocean may be seen. It is necessary, in the first place, to draw attention of the field experts to the fact that the analogy is rather simplified in respect to a construction in operational scale of the invention, serving only the purpose of better understanding the principles involved.

FIG. 4 is a general view of a system of three piles tied to cables that converge towards the surface to a tieing point of the floating body F.

As it is evident to experts, floating body F, due to its apparently reduced density when immersed in water, will be submitted to a vertical upwards push E, which will give it a floating tendency. Contrary to this tendency are the force components $E_1$, $E_2$ and $E_3$ from the three piles acting downwards on the vertical direction. Therefore, cables $C_1$, $C_2$ and $C_3$ are subject to traction, which will increase when push E increases, although it is known that in such a simplified system there is no preventing the weight of the cables themselves will to set their profiles as catenaries.

FIG. 5 is a plan view from above, of the disposition of the floating body F in respect to the mooring piles. It is important to note in that figure the need to keep the floating body F in a position near the center of the circle that enscribes the three piles and that those piles should be so far apart from one another that the circle drawn by the piles is divided into approximately equal sectors to the radii passing by the piles.

Figure 6:
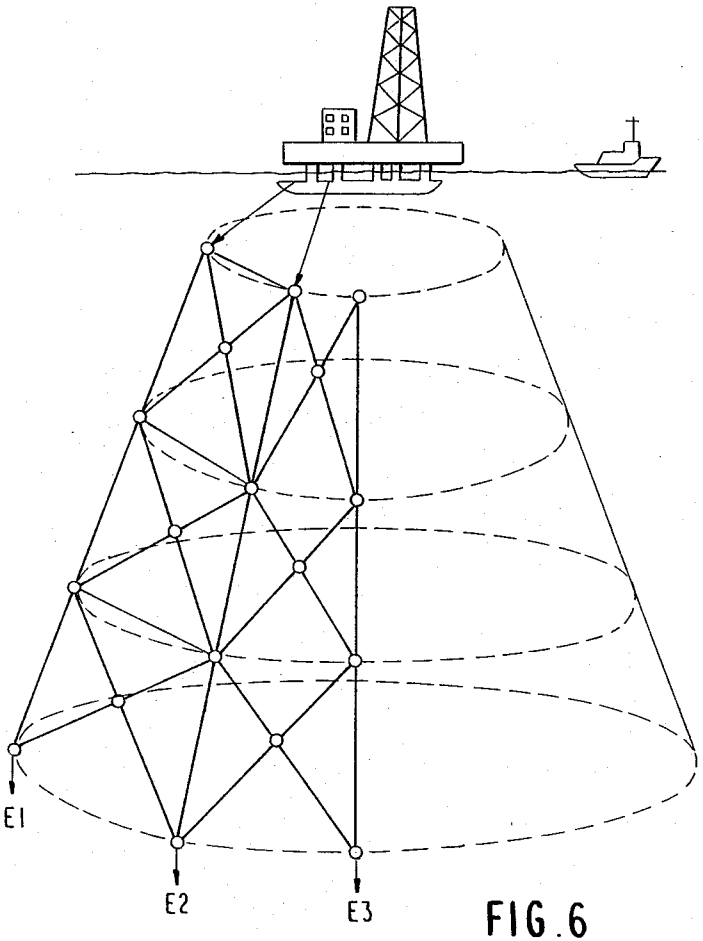

FIG. 6 shows a rather more complex schematic view of the mooring system of the floating unit to the bottom of the ocean. Said system gets complicated by the shape of the cable grid, where the disposition of the cables tied in "nodes" formed by floating spheres has the purpose of minimizing, if not eliminating, the catenary profile effect on the mooring cables.

Figure 7:
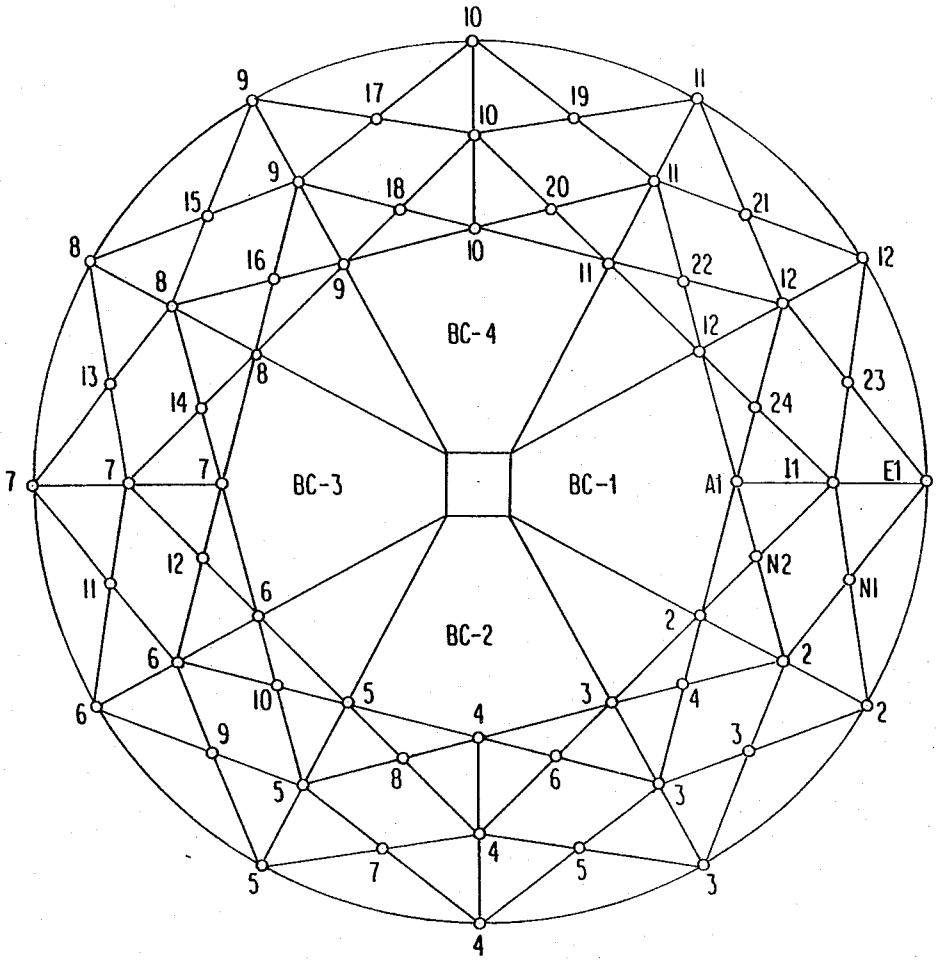
FIGS. 6 and 7 are selective perspective and plan views respectively, of simplified arrangements of one mooring design for an Ocean Floating Support Facility, at the bottom of the sea.

FIG. 7 is a schematic view, as seen from above, of the cables of the layout of FIG. 6, showing the importance for the stability of the mooring system, of a global disposition according to a model with regular star polygons.

For the sake of understanding, the results obtained from a series of hydraulic laboratory tests, which shall be extrapolated for values which will be found in actual scale, shall now be discussed. The configurations are prototypes, while the configurations with laboratory values are models.

It is not included in the scope of this invention the detailing of the several laboratory tests made, where waves were artificially generated with variable periods in an adequate hydraulic channel, where a baffle plate, or a plate of variable thickness submerged at growing depths, simulated the Structure walls to lead to conclusions on dimensions of the prototype for an efficient damping of the sea waves.

Tables II and III summarize the results of a series of laboratory measurements and their extrapolation for a prototype of actual dimensions which were applied to the Structure of the present invention. Data of Tables II and III complete one another.

For reference sake, Table I gives: (a) the periods of the waves considered at the prototype and which reproduce real sea situations within the considered acceptable band; (b) the wave heights and a practical depth of the local were the Structure will be installed.

These values are compared with the model values, which, allowing precise enough measurements, are used for computation of Tables II and III.

TABLE I

| | Prototype | Model |
|---|---|---|
| Period | 8.0 s | 0.60 s |
| | 10.0 s | 0.71 s |
| | 12.0 s | 0.85 s |
| Wave height | 2.0 m | 1.0 cm |
| | 4.0 m | 2.0 cm |
| | 6.0 m | 3.0 cm |
| Depth | 150 m | 75 cm |

Variables shown in Tables II and III are the following: (a) lower level of the PLATE or BAFFLE PLATE, taking for zero value the water line, said level is the expression of the submerged height of the plate and, extrapolated for the prototype, dimension (D3) of the main platform, as seen in FIGS. 2 and 3;

(b) period - is the period attributed to the provoked wave at the channel of the hydraulic laboratory and which incides on the test plate and which is conveniently converted in the real wave hitting the prototype;

(c) thickness of the plate: as seen in Table III is conveniently converted in prototype thickness which, in turn, shall be taken as the useful thickness of a real baffle plate such as, for example, the walls of the UNIT;

(d) $H_i$ - height of the incident wave hitting the plate from the open sea side;

(e) $H_t$ - height of the transmitted wave, located on the PLATE or wall protected side. In our case it would be the UNIT inside marina;

(g) $H_t/H_i$ - the dampening rate. The closer to zero is this rate the larger shall be the dampening efficiency of the wave caused by the PLATE or by the UNIT wall on the columns. In the Tables this value is recorded in percent.

Table II in fact shows the values that can be obtained in practice, while Table III is a summary of these values for more practical comparison purposes.

As seen, the wider the wall acting as baffle plate to the oncoming waves and the larger the immersed part of that baffle plate, the larger the dampening. Therefore under determined conditions, one may expect a perfectly calm sea inside the marina even if there is a rough sea at the ocean outside the UNIT.

From the above discussed Tables it is possible to derive the desirable limits which were chosen for building the walls of the Oceanic Support Floating Unit of the present invention, which are:

width: 20 m or more submerged depth (D-3): 30 m or more

An additional service facility that may be installed on the UNIT is a heliport defined by walls (16), which is sketched in very simply in FIG. 2.

Taking into account the large dimensions of an structure built under the present invention the upper free surface of the structures must be occupied by support installations for maritime operations such as warehouses for storing pipes, valves, chemical products, machines and their spare parts; hotels for operating personnel on neighboring drilling platforms; auxiliary equipment of large size for fire fighting (fire control brigades) and even, in some cases, one FLOATING UNIT can act as base for operational drilling.

With reference to FIG. 2, starting from the concept well known to field experts, according to which the variation of the propagation of the ocean waves is about 90 degrees, the opening (12) which gives access to the interior (17) of the FLOATING UNIT shall be located on one of the walls the direction of which receives the direct impact of the waves. It is evident that to include all the possible practical locations, the configuration shown in FIG. 1 presents a possibility of locating opening (12) of the lateral wall on any of the four walls, as shown in the drawing simply by removing of the convenient gate (11). According to an actuating way mentioned as an example, as shown in FIG. 1, motion of the gates (11) to open the space (12) shall be obtained by varying the ballast of said gates, since with increased weight the gate will submerge, opening the access gate (12) to the interior (17) of the UNIT, while, in the opposite way, removing ballast will cause the gate to float, sliding in its guides (not shown) and closing the opening.

Preferred dimensions for the UNIT are not defined, as they will depend on the specific configuration convenient to the particular use which will be given it, according to the local depth where it will operate, according to the state of the sea (where the frequency variation of the wave impact is included) and the number and size of the boats to be sheltered in the interior (17) of the UNIT.

In a general way (referring to the data in Tables II and III) a safe height of the submerged wall shall be at least 30 m (D-3 dimension) while D2 dimension and consequently total dimension D-1 will greatly depend on working conditions on the surface of the FLOATING UNIT, but this is a particular problem for each configuration type.

Similarly, if a minimum width is set of 20 m for the platform wall as already defined, this shall command the total dimensioning of the UNIT for the sake of security evaluation and economy of the building material.

It is evident for the field experts that the descriptions herein presented, save for certain essential concepts (such as the existence and layout of floats, minimum dimensions, etc.) are only examples of practical configurations of the invention, without otherwise limiting its range, the restrictions in respect to their scope and spirit being linked exclusively to what is contained in the enclosed claims.

We claim:

1. A floating enclosed offshore support structure for stabilized mooring at any point in the ocean by fastening the support structure to the bottom of the sea, said structure comprising:

an upper metallic platform (10) taking the shape of an open square in plan configuration defining an internally open interior (17) and having at least one entrance opening communicating the interior (17) to the exterior ocean, said at least one entrance opening being within a face facing the direction of oncoming waves, said platform face being defined by three distinct parts;

(a) a vertical flat wall (16) located in an upper part of said face;

(b) an intermediate wall (18) formed by a plurality of protruding elements (20) shaped as a section of a tetrahedron as seen by the oncoming waves and by openings (21) between said protruding elements and limited on both sides by lateral walls of adjacent, laterally spaced protruding elements (20), said openings (21) communicating the exterior ocean with, a vertical inner channel (23) within the portion of the platform formed by said vertical flat wall, each inner channel corresponding to each opening and cut in the interior of the platform, through which the water may penetrate violently under the effect of the waves, said inner channel being partially defined by an inner wall shaped to absorb and dampen the force of the incoming water into the opening (21) and the inner channel (23), and at least one special opening (24) communicating with said inner channel (23) to let the water penetrating into the open space (23) to flow through said at least one special opening (24) onto the exterior face of the vertical flat wall (16); and (c) a lower wall (19), flat and vertical, located immediately under the intermediate wall (18) and which, when the structure is positioned in the ocean, stays fully submerged;

said structure further comprising a float system (13) for supporting the platform (10) including floats and spaced columns (14) connecting said floats to said platform such that the floating platform (10) is stabilized over an ocean spot with said floats remaining fully submerged;

a cable system comprising multiple cables ($C_1$, $C_2$, $C_3$ . . . $C_n$) linking said floating structure to mooring piles ($E_1$, $E_2$, $E_3$ . . . $E_n$) fastened to the bottom of the sea, said cables having upper ends fastened to points in the bottom of the floats, and lower ends tied to respective mooring piles.

2. The floating enclosed offshore support structure as claimed in claim 1, wherein the inner channel (23) which communicate with the ocean through openings (21) have inner walls rounded up to deviate the water, forced by the impact of the waves, through said inner channel (23) and through said special opening (24) to return to the ocean.

3. The floating enclosed offshore support structure, as claimed in claim 2, further comprising a ballasted piston (25) mounted in the platform inner channel (23) for vertical movement within said inner channel (23) under the force of the wave for performing useful work.

4. The floating enclosed offshore support structure as claimed in claim 1, wherein the upper metallic platform is submerged to a wet depth of approximately 30 meters.

5. The floating enclosed offshore support structure, as claimed in claim 2, wherein upper metallic platform is defined by lateral walls forming the open interior having a lateral width of about 20 meters.

6. The floating enclosed offshore support structure, as claimed in claim 2, wherein the interior (17) of the platform serves as a boat shelter; with the waves within the open interior being greatly damped in comparison to the rough ocean waters outside said support structure.

7. The floating enclosed offshore support structure, as claimed in claim 4, defined by the expression "$H_t/H_i \times 100$", where $H_t$ is the height of the transmitted wave within the open interior (17) of the platform; $H_i$ is the height of the wave impacting said face from the open ocean, and within the range of 4 to 55 for wave periods of 8.0 to 12.0 seconds and external wave heights of 2.0 to 6.0 meters.

8. The floating enclosed offshore support structure, as claimed in claim 4, wherein the water retained within the opening of the upper metallic platform is totally dampened relative to the waves external of the support structure.

9. The floating enclosed offshore support structure, as claimed in claim 1, wherein said the cables ($C_1$, $C_2$, $C_3$, . . . $C_n$) tying said structure to said piles ($E_1$, $E_2$, $E_3$ . . . $E_n$) forming a reticulated system with multiple nodes, each occupied by a secondary floating element in a manner whereby the catenary effect is alternated over the extent of the cable system.

10. The floating enclosed offshore support structure as claimed in claim 1, wherein the upper metallic platform is provided with at least one lateral vertical opening (12) on each face, and wherein closing gates (11) are provided for each opening whereby only one of the openings may be selectively maintained open for convenience of operation and to maximize the dampening effect of the ocean waves entering the open interior of the upper metallic platform through said one opening.

11. The floating enclosed offshore support structure as claimed in claim 8, wherein the entrance opening to the open interior (17) of the upper metallic platform is at right angles to the plane of the face on the platform which receives direct impact of oncoming sea waves.

* * * * *